US006491568B1

(12) United States Patent
Jankowski

(10) Patent No.: US 6,491,568 B1
(45) Date of Patent: Dec. 10, 2002

(54) PROFILING METHODS AND APPARATUS FOR GENERATION OF MODIFIED GRINDING WORMS

(75) Inventor: Ralf Jankowski, Bad Säckingen (DE)

(73) Assignee: Reishauer AG, Wallisellen (CH)

( * ) Notice: Subject to any disclaimer, the term of this patent is extended or adjusted under 35 U.S.C. 154(b) by 160 days.

(21) Appl. No.: 09/587,807

(22) Filed: Jun. 6, 2000

Related U.S. Application Data

(63) Continuation-in-part of application No. 09/020,898, filed on Feb. 9, 1998, now Pat. No. 6,077,150.

(30) Foreign Application Priority Data

Feb. 21, 1997 (DE) ..... 197 06 867

(51) Int. Cl.[7] ..... B24B 1/00; B24B 49/00; B24B 51/00

(52) U.S. Cl. ..... 451/5; 451/8; 451/47; 451/56; 451/72; 451/253

(58) Field of Search ..... 451/5, 8, 9, 10, 451/11, 47, 48, 147, 219, 253, 275, 56, 72

(56) References Cited

U.S. PATENT DOCUMENTS

| | | | | |
|---|---|---|---|---|
| 4,475,319 A | | 10/1984 | Wirz | 451/5 |
| 4,860,501 A | | 8/1989 | Belthle | 451/48 |
| 4,993,194 A | * | 2/1991 | Cadisch | 451/253 |
| 4,998,385 A | | 3/1991 | Umezono et al. | 52/563 |
| 5,129,188 A | | 7/1992 | Alverio | 451/48 |
| 5,325,634 A | | 7/1994 | Kobayashi et al. | 451/253 |
| 5,339,794 A | * | 8/1994 | Thyssen | 451/47 |
| 5,954,568 A | * | 9/1999 | Wirz | 451/147 |
| 6,012,972 A | * | 1/2000 | Jankowski | 451/47 |
| 6,077,150 A | * | 6/2000 | Jankowski | 451/147 |

FOREIGN PATENT DOCUMENTS

| | | |
|---|---|---|
| DE | 37 04 607 | 8/1988 |
| WO | 95-24989 | 9/1995 |

* cited by examiner

*Primary Examiner*—Timothy V. Eley
(74) *Attorney, Agent, or Firm*—Sughrue Mion, PLLC

(57) ABSTRACT

Method and an apparatus for the profiling of single-gear or multiple-gear grinding worms for grinding tooth profiles in accordance with the principle of continuous diagonal generating grinding. A grinding worm is divided into at least two axial zones wherein one zone remains unmodified and a second zone receives, by means of special profiling methods, modifications of the thread flanks for the generation of tooth flank modifications The main attribute of these profiling methods is additional movements, which are superimposed on the disk-shaped profiling tool and/or the grinding worm in relation to a given profiling shift position, and which result in the modifications of the grinding worm flanks that are mapped onto the flanks of the toothed wheel work during subsequent diagonal generating grinding across a grinding worm zone profiled in this manner. Additional movements designed to generate the modifications include, in particular, pivoting of the profiling tool around an axis (F) or pivoting the grinding worm around an axis (C) during profile dressing, as well as continuous incline change during line-by-line profiling.

6 Claims, 10 Drawing Sheets

U
V
Pi
Pr
Vrel
Urel
ΔV
ΔU
ΔF
1
4
7

PROFILING METHODS AND APPARATUS FOR GENERATION OF MODIFIED GRINDING WORMS

This is a Continuation-In-Part of application Ser. No. 09/020,898 filed Feb. 9, 1998, now U.S. Pat. No. 6,077,150.

RELATED APPLICATIONS

This patent application is a continuation-in part patent application of U.S. patent application Ser. No. 09/020 898 filed on Feb. 9, 1998 and claiming priority of German patent application No. 197 06 867.7 filed on Feb. 21, 1997. These two patent applications are declared an integral part of the present patent application.

FIELD OF THE INVENTION

This invention relates to a method for the generation of a single- or multi-start grinding worm for grinding tooth profiles in accordance with the principle of continuous diagonal generation grinding, and an apparatus for implementing this method, by which across a portion of the worm width the flanks of the worm thread are given modifications, and the ratio between the modified and the non-modified grinding worm zone yields an optimum with respect to a favorable exploitation of the overall worm width.

BACKGROUND OF THE INVENTION

The majority of cylindrical gears used in gear drive technology today have involute tooth profiles. However, for load reasons, the meshing of two involute gears often fails to produce an optimal operating behavior, so the tooth flanks are provided with modifications deviating from the involute, in both the profile and longitudinal directions by means of design calculations. As the magnitude of such modifications for the most part falls within the micrometric range, grinding processes play an essential role in the manufacture of modified tooth flanks.

The more straightforward modifications of tooth flanks consist primarily of profile or longitudinal crowning, tip or root relief in relation to profile and end relief in relation to face width If we view these modifications in terms of their variation in the two tooth flank directions (tooth depth and face width), we can see that they are tooth flank modifications that always change in the one tooth flank direction only, while remaining constant in the second tooth flank direction. In continuous generating grinding, these modifications can be achieved either by means of profiling of the grinding tool with special profiling tools (generally profile modifications) or by means of appropriate movement of the machine axes (generally longitudinal modifications). In the latter case, these additional axial movements during continuous generating grinding often result in unwanted distortion of the tooth flank profile.

In contrast, the application of more complicated tooth flank modifications requires varying specifications in a number of transverse sections and on a number of cylinders. In extreme cases, each point on the flank of the tooth can be allotted its own modification magnitude (deviation of the profile from the involute). The manufacture of such gearing by means of continuous generation grinding requires special technological procedures.

The state of the art for the profiling of grinding worms remains an important factor in arriving at a solution. In the known processes in this respect (FIG. 1) a disk-shaped profiling tool 1 is often used. This profiling tool is shifted in a translatory linear stroke 3 relative to a rotating grinding worm 2 during which the profiling tool contacts the tip and/or the root of one or both flanks of the grinding worm thread 4. The stroke action 3 of the profiling tool and the rotational movement 5 of the grinding worm 2 are precisely attuned to one another, so that after one revolution of the worm the profiling tool has traveled a path as $\pi$ * module * number of starts. Of the multitude of procedural specifications applied in this regard, two general principles are known.

When profiling with a profile roll (FIG. 1*a*), the active zone 6 of the disk-shaped profiling tool 1 has a single-tapered or double-tapered profile. During the profiling procedure, this shape leads to line contact between the profiling tool 1 and a normal section of the grinding worm thread 4. The advantage of this contact relationship is that the entire depth of the grinding worm thread (h), including the root and tip zones, can be. profiled with a single translatory stroke 3 of the profiling tool or of the grinding worm 2 across the width of the grinding worm ($b_5$). The result is short profiling times. As with this method a large portion of the flank depth of a worm thread axial section is always engaged (generally the entire profile), it will be referred to hereinafter as profile dressing.

Profiling with a universal roll (FIG. 1*b*) uses a disk-shaped profiling tool having, for example, a radius profile in the active zone 6. With this tool, the contact between the profiling tool 1 and the grinding worm thread is almost punctiform. Thus, only a very limited portion of the grinding worm thread depth (h) is profiled during each stroke 3 across the width of the grinding worm ($b_5$). A multitude of profiling strokes is needed to profile the entire grinding worm thread, the profiling tool being infed by a defined amount ($\Delta U$) into the grinding worm thread depth after each stroke. This profiling method leads to long profiling times, particularly in the case of grinding worms with large modules. However, it is also known that, because of the point contact in the zone of contact, this method is very advantageous for the generation of virtually any desired modifications down the profile grinding worm thread profile. In the following text, this method will be referred to as line-by-line profiling.

In a known process for producing complicated tooth flank modifications in generation grinding, the grinding tool is tangentially displaced in relation to the gear during the working stroke (shifting or diagonal generative grinding) (DE 3704607). A special feature of this generation grinding process is that, because of the tangential shift during the cutting stroke, a new line of action between the gear and the grinding worm can be allocated to every gear normal section. By the use of a grinding worm that has a worm thread of continually changing pressure angle across its entire active width, the aforementioned process compensates for process-related distortion of the tooth flank. This distortion occurs during the continuous generation grinding of helical gears if the center distance between the workpiece and the tool changes during the working stroke (e.g., when producing longitudinal crowning). A disadvantage of this procedure is that the grinding worm receives altered pressure angles (modifications) across its entire active width, and hence, when grinding worms are used with conventional abrasives, there is increased wear in those worm zones where grinding proceeds at higher metal removal rates. On the other hand, if non-profilable grinding worms with superhard abrasives are used, the flexible profiling of the grinding worm thread with new pressure angle changes (modifications) is not possible.

In regard to line-by-line profiling, a process is known (Wo 95/24989) in which, according to the tooth flank modifications to be generated, a grinding worm is provided with different modifications in various width zones. Applying line-by-line profiling of the grinding worm, these individual width zones are given modifications down the profile of the thread which differ from zone to zone but remain constant within a given zone. Between the individual width zones of the grinding worm, there are transitional zones in which a transition occurs between the thread profile modification of one width zone and the thread profile modification of the following width zone. The generation of continuous flank modifications in the direction of worm width and, consequently, in the gear tooth longitudinal direction, is not possible with this process.

SUMMARY OF THE INVENTION

Beginning with the known state of the art (as described above), the task presented is to provide a grinding worm with a geometry and flank topology which, on the one hand, permit high metal removal rates and on the other hand, permit the generation of tooth flank modifications on the micrometric level. This task, in turn, entails a need to develop methods or a combination of these methods which allow for flexible profiling of grinding worms with modified thread flanks. In doing so, we must also decide which modifications of the grinding worm thread flanks can be generated with which profiling method or with which combination of profiling methods, with due consideration for the quality demands on the gearing to be ground, and for the goal of minimizing profiling time. Finally, an apparatus must be developed which can be used to execute the profiling process or combination of profiling processes.

The solution to this task is based on the two known fundamental methods for profiling grinding worms, viz.: profile dressing and line-by-line dressing, as well as on the diagonal generation grinding of gears.

BRIEF DESCRIPTION OF THE FIGURES

A description of preferred embodiments of the invention is given in the following with reference to the drawings, in which.

DETAILED DESCRIPTION OF THE PREFERRED EMBODIMENTS

Figure 2A:
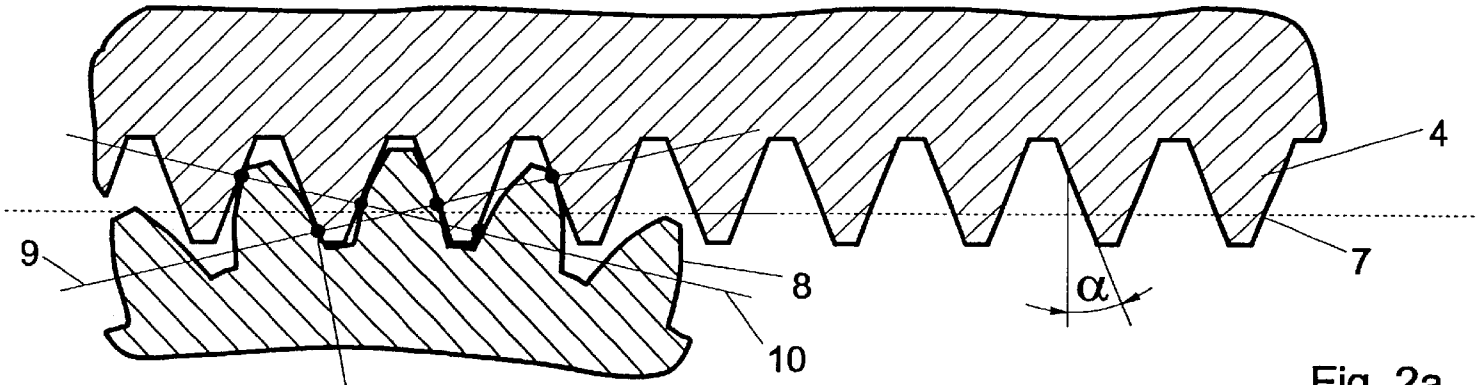
FIG. 2*a* shows contact conditions during continuous generation grinding.
Figure 2B:
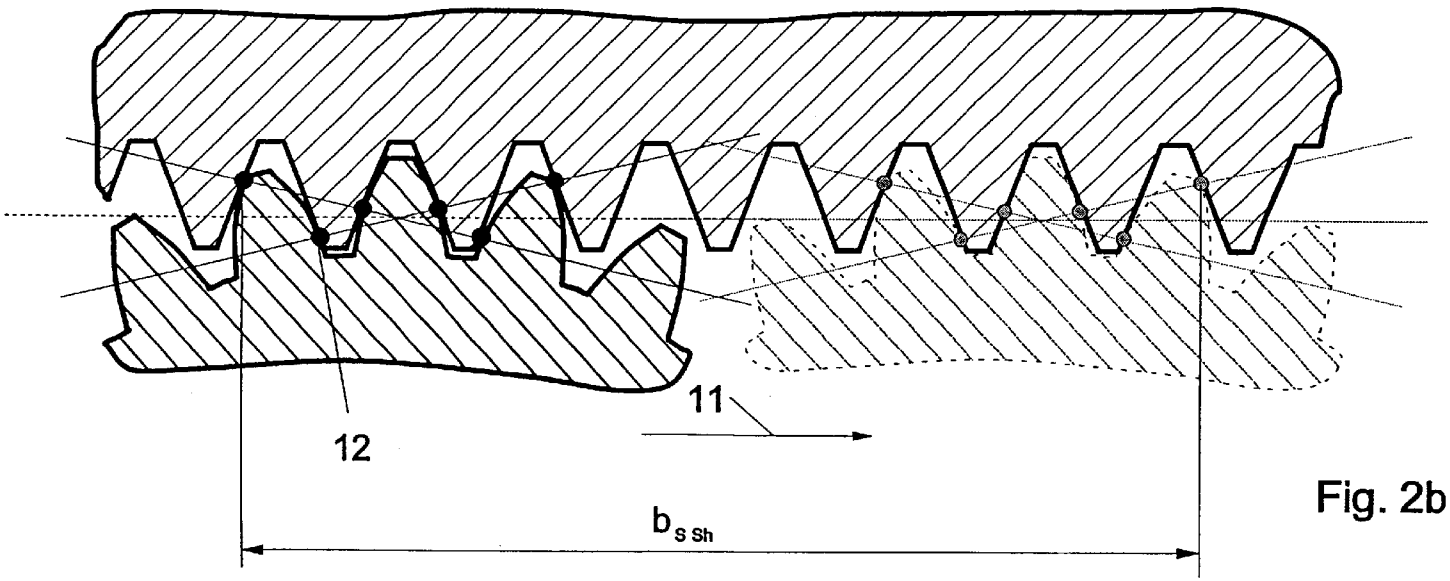
FIG. 2*b* shows a translatory stroke during continuous diagonal generation grinding.

In accordance with FIG. 2, to generate involute tooth flanks without modifications, a tool profile (basic rack profile) is used that constitutes a rack 4 with straight tooth flanks 7, which are inclined at the gearing pressure angle $\alpha$ relative to the vertical to the profile datum line. With reference to the lines of action for the right flanks 9 and left flanks 10 (FIG. 2*a*) formed by the engagement between the involute profile 8 to be generated and the basic rack profile 4, together with the translatory action 11 (FIG. 2*b*) additionally occurring during diagonal generation, an adequate approximation can be made via a conversion formula for the allocation of any point on the tooth flank to a contact point 12 on the relevant normal section of the grinding worm thread 4 (basic rack profile).

We can obtain an adequate approximation, by means of a transformation. Depending on the shift feed rate and the gear face width, we obtain in the axial direction of the grinding worm a path ($b_{ssh}$) that is traveled by the gearing during the working stroke. If this conversion calculation is performed for a network of tooth flank points, modification values (plus/minus deviation of the tooth flack profile from the involute) for defined tooth flank points can be allocated to specific contact points on the worm thread flank. Thus, for a normal section of the grinding worm thread at a defined position $V_j$ across the grinding worm width, modification values ($M_{ij}$) in relation to the worm thread depth h, as depicted for example in FIGS. 3*a* and 3*b*, are obtainable for the basic rack profile (plus/minus deviations of the flank profile of the grinding worm off the involute basic rack profile).

Thus, in a first step the desired modifications of a tooth flank are transformed to the flank of a grinding worm thread. It should be noted that, because of the counter-part principle, the algebraic signs of the modifications are reversed by the mathematical conversion. Points on the grinding worm thread flank that do not come into contact with the tooth flank are assigned a modification value of zero. The conversion calculation supplies the desired profile for the flanks of a modified grinding worm thread at any point across the worm width.

Figure 3A:
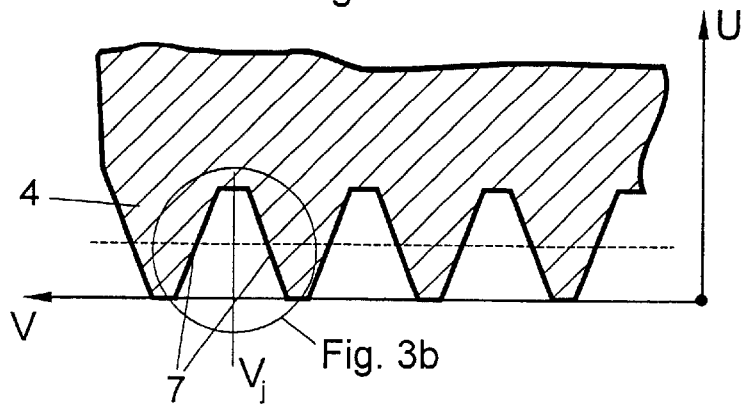
FIG. 3*a* shows modifications of the thread flank down the profile for the normal section a grinding worm thread.
Figure 3B:
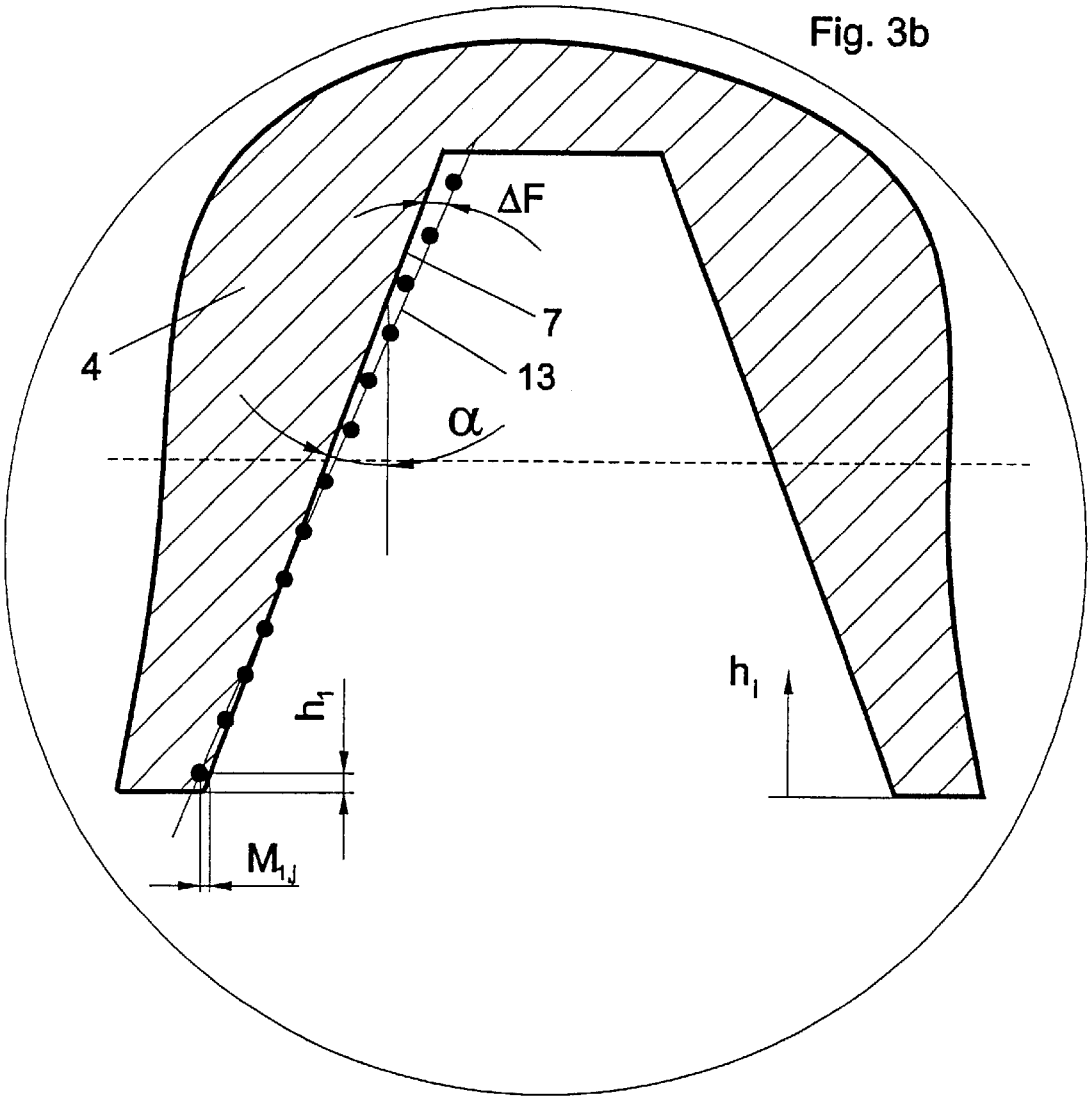
FIG. 3*b* shows a part of FIG. 3*a* in a bigger scale.

The time-effective production (profiling) of the desired profile of the modified grinding worm thread flanks is achieved by means of profile dressing, and consists for the first part in applying a compensating formula to establish, for flank pairs 7 of the normal section of the grinding worm thread 4 at a specific worm width position $V_j$, the relationship of the modification values $M_{ij}$ to the worm thread depth position $h_i$ (FIGS. 3*a* and 3*b*). Any constant functional law can be used as the compensating function, but it should be noted that once a law has been selected it must continue to be applied to calculations for additional normal sections of the worm thread. If, for example, the linear function is selected as the compensating function, the calculated gradient of the compensating straight line 13 represents an angle ($\Delta F$) by which the pressure angle of the modified basic rack profile deviates from the pressure angle of the flank 7 of the unmodified basic rack profile at the relevant grinding worm width position ($V_j$). If this compensation calculation, using the selected functional law, is performed for a plurality of normal sections of the worm thread across the worm width $b_s$, we obtain a general relationship between the gradient values, i.e. the angle (ΔF) and the grinding worm width position ($V_j$).

With reference to the pivoting of the profiling tool, we thus obtain in a second step the following relationship:

$$\Delta F=f(V),$$

or with reference to the pivoting of a grinding worm the relationship:

$$\Delta C=f(X).$$

It is evident in FIGS. 4*a* to 4*d* that, as a result of the pivoting motion around a rotational point ($P_l$) (rotational axis F), the flank of the profiling tool 1 is brought out of the desired position with respect to its infeed position (U axis) and stroke position (V axis) relative to the flank 7 of the grinding worm thread 4. Consequently, the deviations in position resulting from the pivoting motion of the profiling tool 1 must be compensated by means of simultaneous correcting movements ΔU and ΔV (FIGS. 4*c* to 4*f*) in the directions U and V (for the profiling tool) and/or ΔX and ΔY in the directions X and Y (for the grinding worm). The magnitude of these correction movements is primarily dependent on the magnitude of the pivoting angle ΔF, as well as on the position of the real point of rotation (P*r*) of the F axis relative to the virtual point of rotation ($P_j$) on the flank of the profiling tool during profiling. They can be calculated by means of the following relationships:

$$\Delta V=f(\Delta F,\ U_{rel},\ V_{rel}),$$

$$\Delta U=f(\Delta F,\ U_{rel},\ V_{rel}).$$

Figure 5:
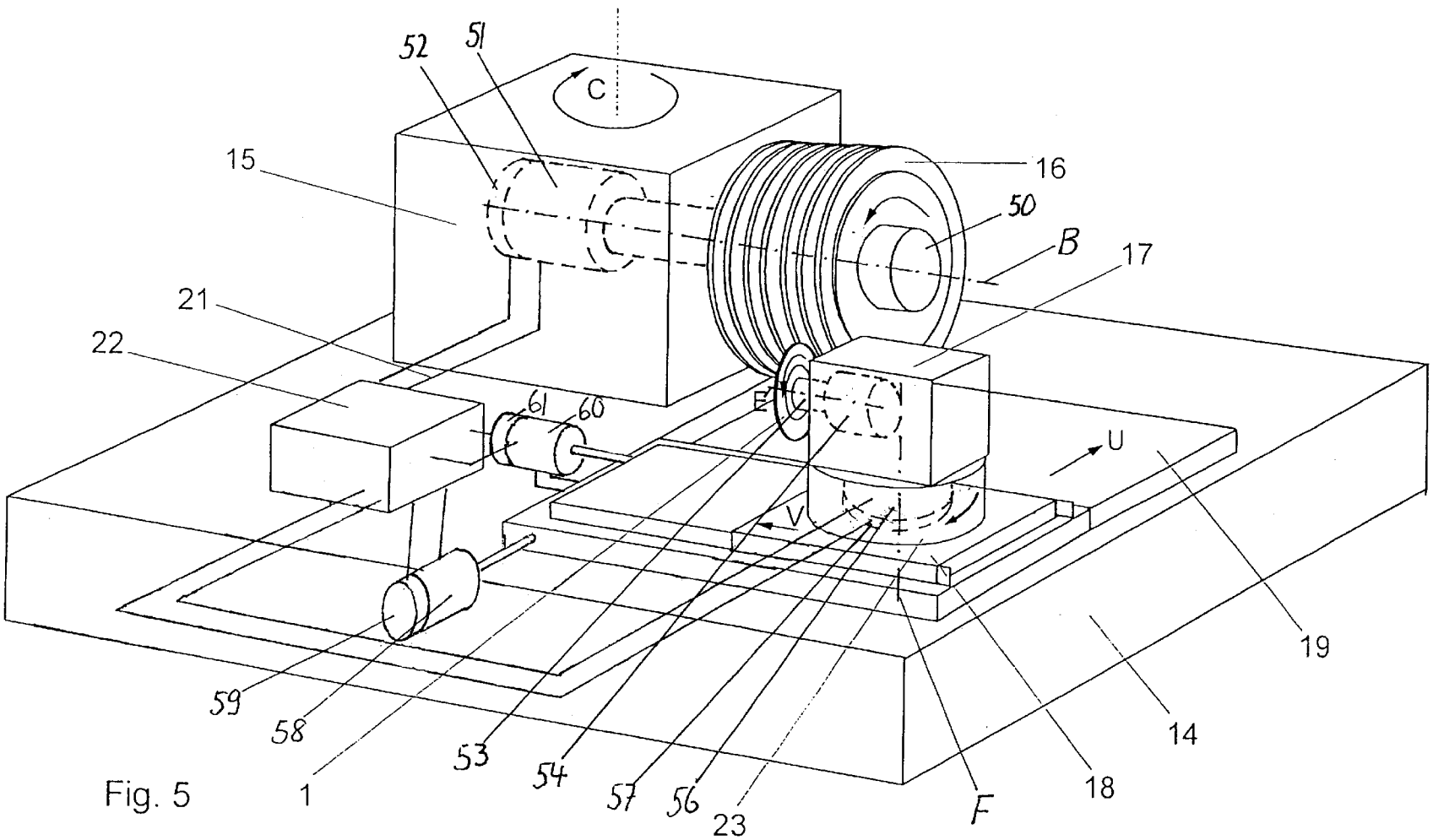
FIG. 5 shows a device for execution of the proposed profiling method.

Comparable conditions occur by the pivoting of the grinding worm around a rotational axis C (FIG. 5). In this case, the correcting movements are given by:

$$\Delta Y=f(\Delta C,\ X_{rel},\ Y_{rel}),$$

$$\Delta X=f(\Delta C,\ X_{rel},\ Y_{rel}),$$

The proposed profiling process can be performed with the device depicted in FIG. 5. The figure depicts a variant in which the profiling tool performs the translation stroke and infeed movements as well as the pivoting movement. Comparable variants are possible in which the grinding worm performs the translation and infeed movement as well as the pivoting movement, or in which appropriate combinations of these movements are performed.

Figures 4A, 4B, 4C, 4D, 4E, 4F:
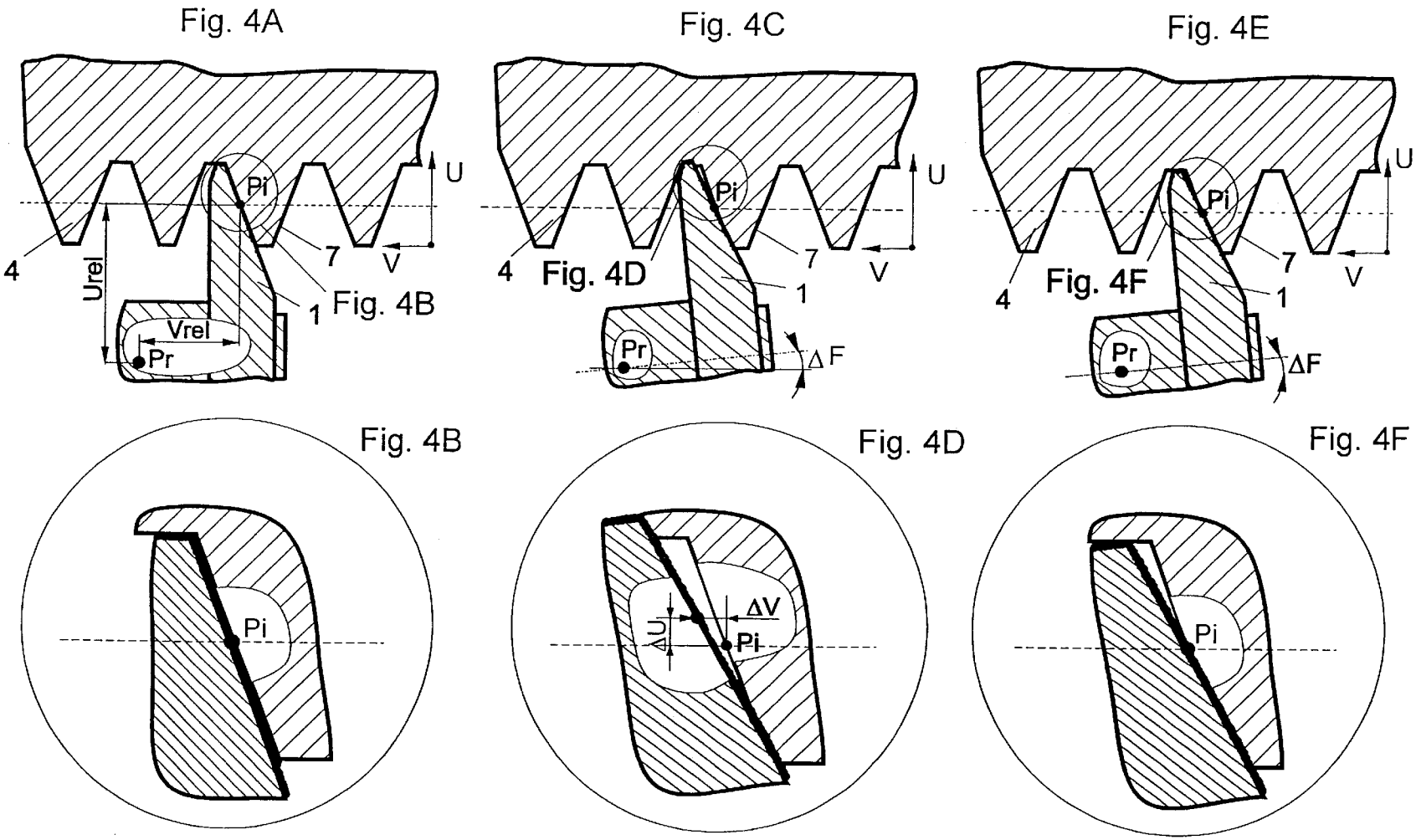
FIGS. 4*a* to 4*f* show a profiling method for producing grinding worm flank modifications by means of profile dressing, FIGS. 4*b*, 4*d*, and 4*f* respectively showing parts of FIGS. 4*a*, 4*c*, and 4*e* in a bigger scale.

The apparatus depicted has a spindle unit 15 located on a base plate 14. Located in radial bearings in the spindle unit 15 is a grinding spindle 50 rotating about a horizontal axis B. The grinding spindle is connected to a motor 51 and a rotary encoder 52. The grinding worm 16. to be profiled is set up on the grinding spindle 50. Located in radial bearings in a spindle unit 17 is a work spindle 53 rotating about a horizontal axis E. Fitted to the spindle 53 is the disc-shaped profiling tool 1. The spindle 53 is connected to a motor 54. The spindle unit 17 is located on a turn-table 23, which is pivotable via a motor 56 about an axis F perpendicular to the axis B and to the infeed direction U. The angle of rotation of the turn-table 23 is measured with a rotary encoder 57. The turn-table is fitted to a compound slide comprising an infeed slide 19 and a longitudinal slide 18. the slide 19 is guided in guideways on the base plate 14, and can be infed via a motor 58 in direction U at right angles to the axis B. The travel of the slide 19 is measured with a linear encoder 59. The slide 18 is displaceable on the slide 19 via a motor 60 in the direction V parallel to the axis B. The stroke of the slide 18 is measured with a linear encoder 61. All motors 51, 54, 56, 58, 60, and linear and rotary encoders 52, 57, 59, 61 are connected to an NC control unit 22. This control unit 22 is programmed such that firstly the dressing tool 1 is infed via slide 19 such that its active flank makes contact with one flank 7 of the grinding worm thread (FIG. 4*a*). Then by means of the slide 18 the profiling tool 1 performs a stroke action parallel to the axis B. This stroke action is so synchronized with the rotary action of the grinding worm 16 that after one worm revolution the profiling tool 1 has covered the distance π•module•No.-of-starts. Simultaneously and in synchronism with the stroke action of the slide 18,—at least over a part of the width of the grinding worm 16—the turn-table 23 is swiveled continuously, and the synchronous action of the slide 18 is superimposed with the appropriate correction increment ΔV, and furthermore byway of the slide 19 the correction increment ΔU is performed (FIG. 4D).

Instead of the swivel action of the spindle unit 17 about the axis F, the spindle unit 15 can also be pivotable about the axis C. In this case the infeed action and the stroke action of the profiling tool 1 relative to the grinding worm 16 can each be realized by way of combined actions of the spindle units 17 and 15 relative to each other in the directions U and V. In both cases the pivot axis F or C is perpendicular to the displacement directions U and V. The axis B is parallel to a plane which is parallel to the directions U and V.

When a grinding worn thread has been profiled by means of the process described above and by using the said apparatus, the flank pressure angle of the thread changes continuously across a width zone of the grinding worm, thus constituting the actual modification of the worm thread flanks.

Figure 1B:
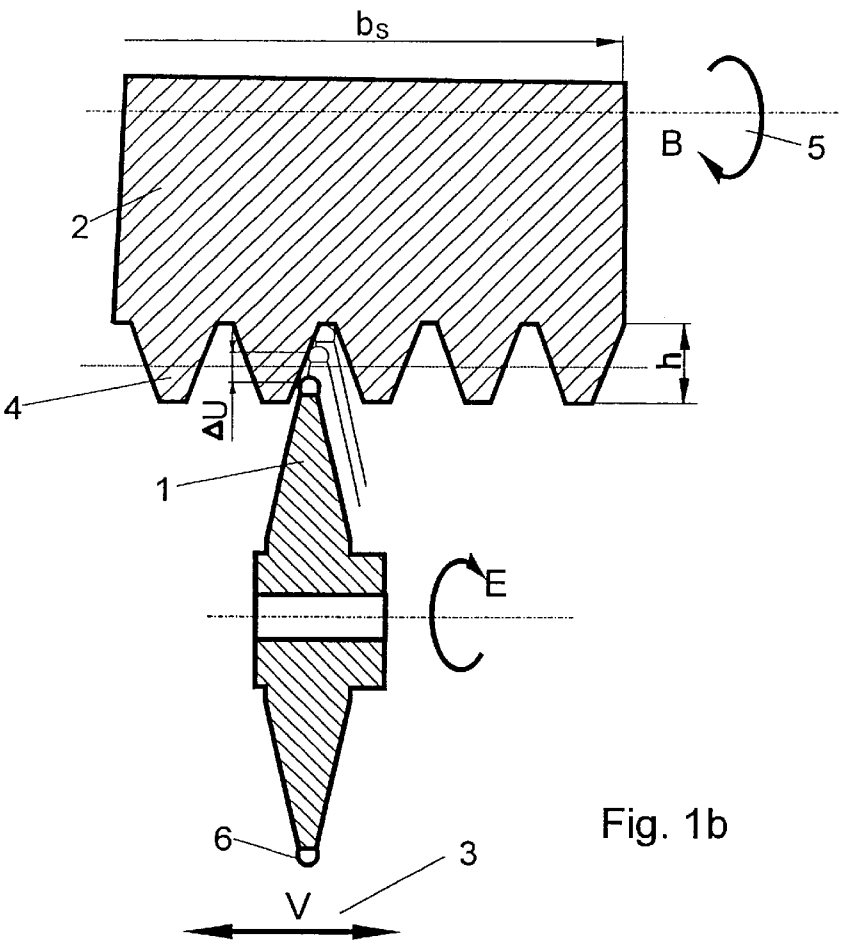
FIG. 1*b* shows the principle of line-by-line profiling of grinding worms.
Figure 1A:
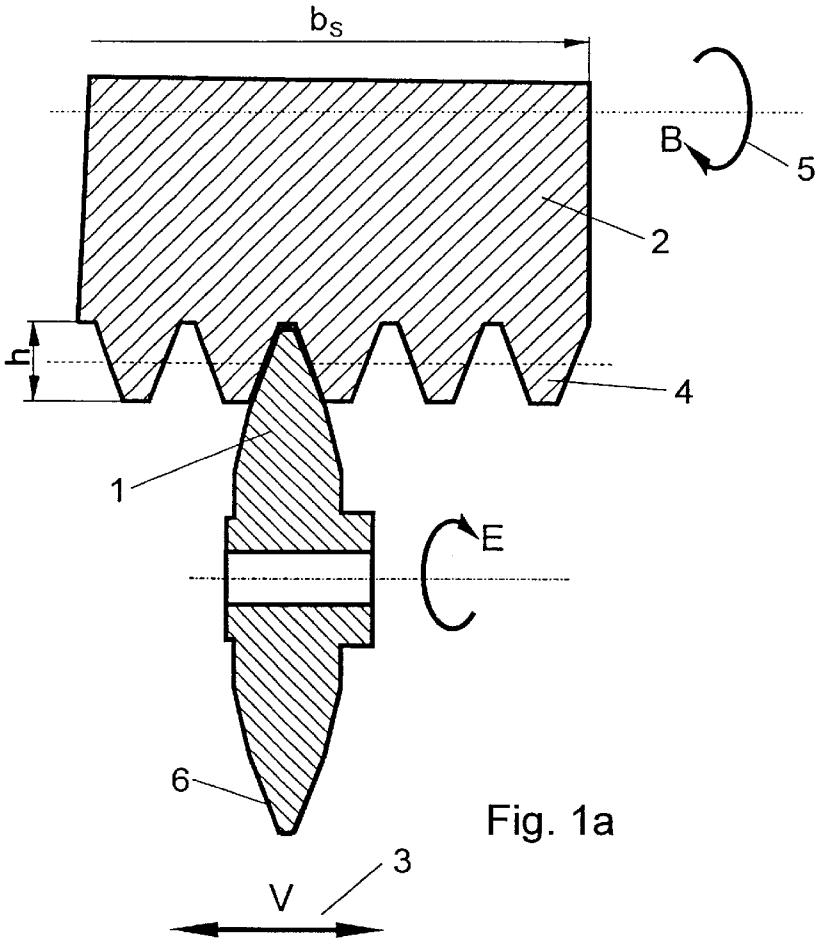
FIG. 1*a* shows the principle of profile dressing of grinding worms.

As described earlier, the position of the angle of rotation of the F-axis in relation to the profiling spindle unit or of the C-axis in relation to the grinding worm spindle unit is obtained by means of compensation calculations performed for a plurality of grinding worm width positions ($V_j$). With the aid of the coefficients of the compensation functions, the actual modification values that develop during profiling can be calculated. These deviate to a more or less extent from the specified desired modification values based on the compensation calculations. It is therefore useful to calculate, via the compensation functions, the actual modification values for the desired modification values, in order to acquire a deviation matrix (residual errors across worm width and thread depth. To apply the described profiling process advantageously, all values in the calculated deviation matrix must be smaller than a previously defined threshold value. If this is not the case, the proposed productive profile dressing (FIG. 1*a*) cannot be employed to produce the modifications of the worm thread flank. In this case, the relative differences between the modification values for adjacent flank points of a worm thread axial section are so great that line contact between the thread flank and the profiling tool does not produce the required modification quality over the entire worm thread depth.

The deviation matrix is to be furthermore examined to determine whether the residual errors are inadmissibly great over the entire depth of the grinding worm thread or only over portions. If the residual errors are too great over the entire thread depth, the second profiling process proposed below must be applied. This is based exclusively on line-by-line profiling of the worm thread, and is thus very flexible with respect to the generation of modifications of the worm thread flanks If, however, the residual errors are only too great in the tip and/or root zones of the worm thread, a combination of the profile dressing and line-by-line profiling processes is possible.

Figure 6A:
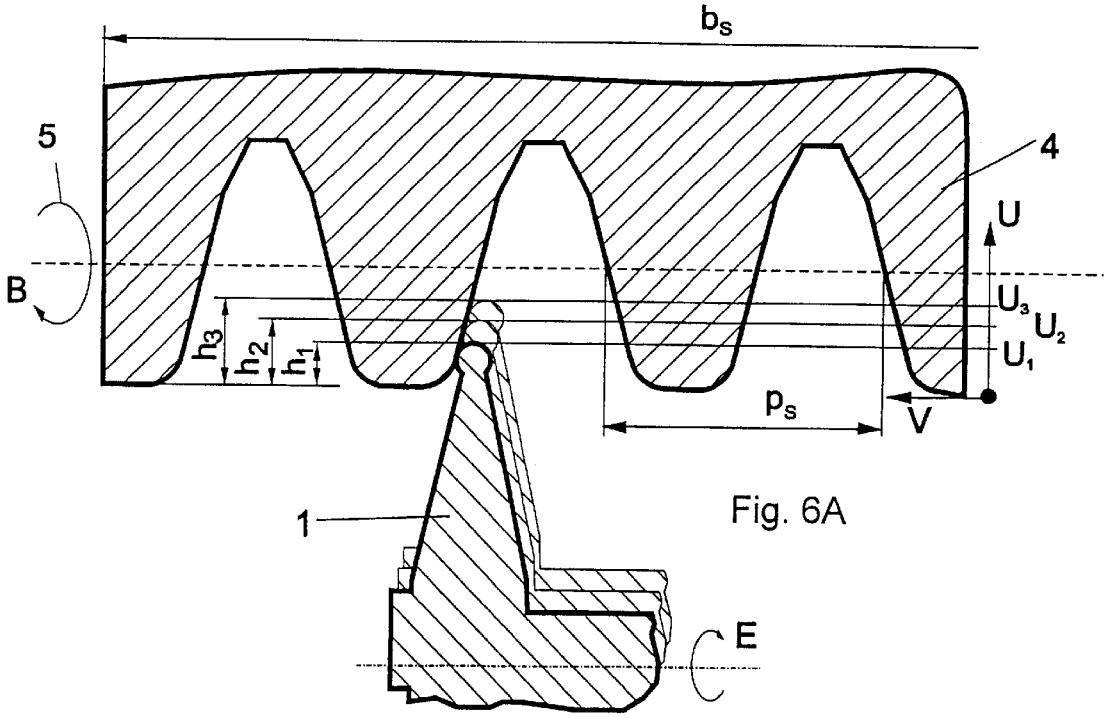
FIG. 6*a* shows a profiling method for producing grinding worm flank modifications by means of line-by-line profiling.
Figure 6B:
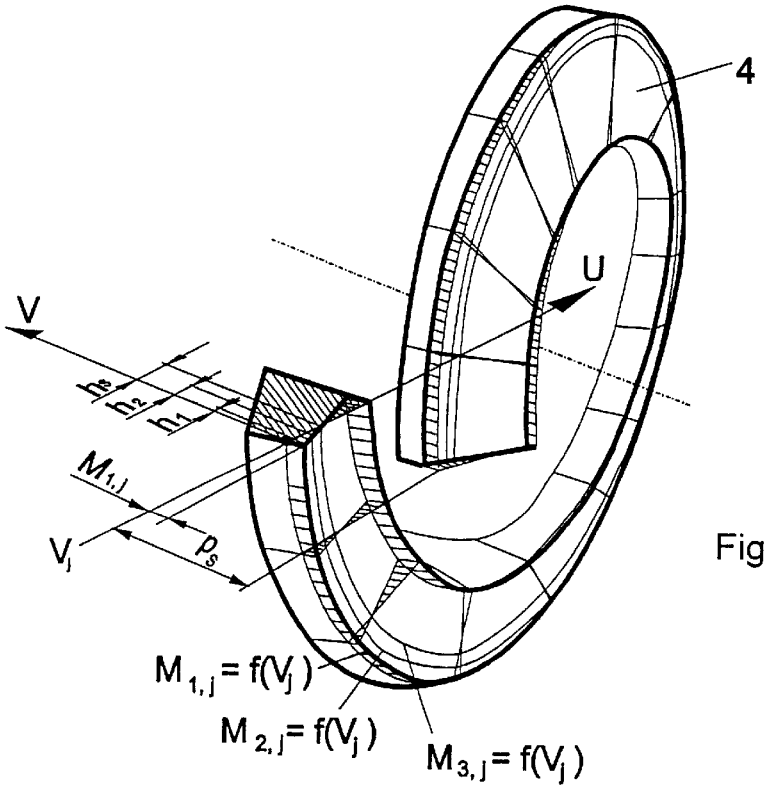
FIG. 6*b* shows a part of the worm thread of FIG. 6*a* as viewed from an alternate position.

The starting point for the application of line-by-line profiling consists once again in the precise allocation of the tooth flank coordinates to the contact points on the flanks of the grinding worm thread including the conversion calculation described earlier. Referring to line-by-line profiling of a worm thread, the conversion calculation can be used to establish for each profiling line (i), i.e. for each worm thread depth coordinate $U_i$, a relationship between the modification values $M_i$ of the worm thread flank and the worm width position ($V_j$) (FIGS. 6*a* and 6*b*). This results in the overall relationship:

$$M_{ij}=f(U_i, V_j)$$

If we now position a profile roll 1 at a defined depth ($h_i$ or $U_1$) of the worm thread 4 and control the profiling stroke movement across the worm width ($b_s$) as a function of both the basic lead ($p_s$) of the worm thread 4 and the modification values ($M_{ij}$) for this thread depth ($h_i$), the desired modification for the profiling line will be generated at depth $h_i$. Thus, in line-by-line profiling of modifications, the stroke action of the profiling tool 1 and the rotation 5 of the grinding worm are not only coupled in relation to the basic lead of the grinding worm ($P_s$), but also in relation to the modification values ($M_{ij}$), which were obtained across the width of the worm for each profiling line by applying the transformation calculation.

By applying this procedure to all profiling lines (i) needed for complete profiling over the depth (h) of he grinding worm thread 4, a virtually point-by-point transfer of the modifications of the tooth flanks to the corresponding contact points on the worm thread flanks is possible. In the zone of the grinding worm modified in this manner, the resulting lead of the worm thread 4 changes continually from one profiling line to the next, as well as along a profiling line (across the width of the worm). As with the first proposed profiling process, the tooth flank modifications are generated by diagonal generative grinding across the modified zone of the grinding worm.

Figure 9:
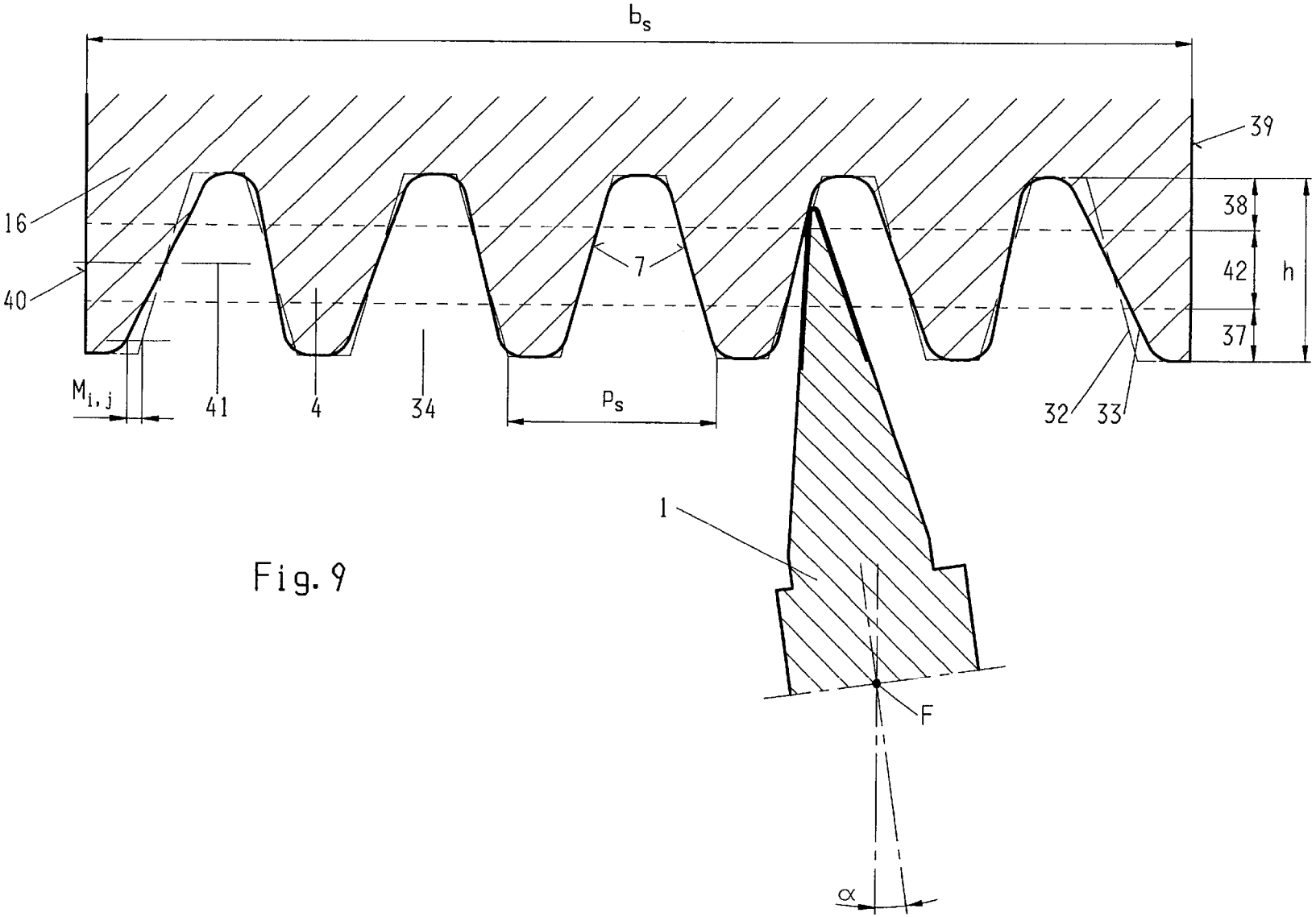
FIGS. 9 to 11 show the combination of profile- and line-by-line-profiling and the respective profiling tool.
Figures 10, 11:
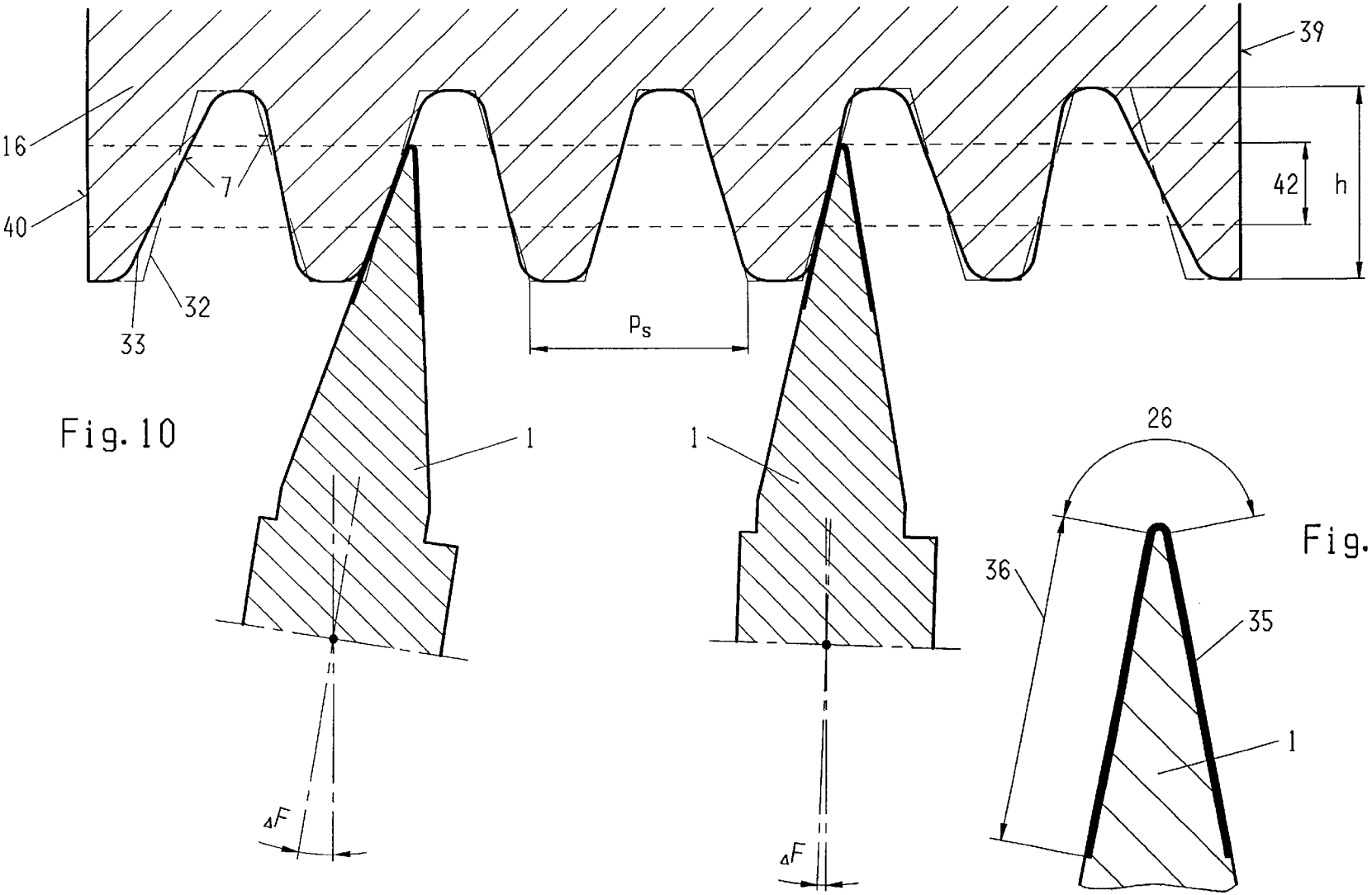

As already mentioned, tests have shown that line-by-line profiling over the entire worm thread depth (h) is often not needed in order to maintain the required precision of modifications over the whole thread depth. Above all, the change in modification values in the middle flank zone (as viewed across the thread depth) is often so small that profile dressing is also possible. In contrast, the modification values in the tip and root zones of the worm thread are generally such that line-by-line profiling is necessary. Thus, another option for generating the specified desired profile of the grinding worm thread consists of a combination of the two profiling methods described above. The tip and root zones of the worm thread, which are generally characterized by a substantial change in modification values, are profiled by line-by-line profiling, including the continuous lead change to produce the modifications. The middle zone on the other hand is profiled—still maintaining the required precision of the modifications—by means of the more productive profile dressing process, employing the previously mentioned pivoting movement to produce the worm thread flank modifications. In this manner, we reach a compromise between the two objectives of quality of the modifications and quantity during profiling. FIGS. 9, 10 and 11 depict the combination of the two previously described profiling methods, with a further variant of dressing tool. The dressing tool 1 has a peripheral, torus-shaped active working surface extremity sector 26 coated with hard abrasive grains 35 (as in the design according to FIG. 7), and the tangentially adjoining conical sectors 36, which are likewise coated with hard abrasive grains 35 (FIG. 11) and are of defined contour (e.g. crowning).

In FIGS. 9 and 10 the nominal profile 32 of the worm thread 34 of the grinding worm 16 is indicated with chain-dotted lines, in contrast to the modified. actual profile 33 with bold lines, where the magnitudes of modification $M_{i,j}$ are shown exaggerated for the purpose of better clarity. As depicted in FIG. 9, an outer zone 37 and an inner zone 38 of the depth h of the flanks 7 of the worm thread 34 are dressed line by line with the active surface 26 of the profiling tool 1, as was explained in connection with FIG. 6*a*, where the profiling tool 1 is inclined at a constant angle α about the axis F during profiling. The feed action of the profiling tool 1 in the direction of the axis of rotation B of the grinding worm 16, amounting to the lead ps of the worm thread 4 per revolution of the grinding worm 16 is superimposed by a modification increment $M_{i,j}$ which, in the example selected here, alters continuously from one end face 39 of the grinding worm 16 to the other end face 40, the said modification increment $M_{i,j}$ diminishing from profiling line to profiling line towards the center line 41 of the worm thread 34.

A middle sector 42 of the thread depth h of the grinding worm thread. 34 is in contrast dressed by the form dressing method with the active surfaces 36 of the profiling tool 1 (FIG. 10). To this purpose the one surface 36 is for example brought into contact with the middle sector 42 of the left flank 7 of the grinding worm thread 34. During the stroke of the profiling tool 1 relative to the grinding worm 16 parallel to the grinding worm axis B across the grinding worm width $b_s$, which is in turn synchronized with the angle of rotation of the grinding worm 16, the profiling tool 1 is swiveled continuously relative to the grinding worm 16 about one of the axes F or C. In the process the swivel angle ΔF changes continuously from one end face 39 to the other end face 40. The entire middle sector 42 can in this manner be profiled in a single pass, so that the dressing time can be substantially reduced.

In this example, of course, the modified zone of the grinding worm thread 34 might also only extend over a sector,$b_{sII}$(FIG. 8) of the width $b_s$ of the grinding worm 16, whereas a second sector ($b_{sI}$) receives the non-modified profile 32 and is dressed with the sector 36 of the profiling tool 1. Here two passes of the profiling tool 1 are required, the left flank 7 being dressed in one pass, and the right flank in the other. It is also possible, however, to dress this non-modified sector $b_{sI}$ in a single pass with a second, appropriately wider profiling tool, as in FIG. 1*a*.

The breadth of this sector 42 will. of course be made as large as possible, in order to minimize the dressing (profiling) time. It depends on the size of the tip and root fillet radii of the worm thread 34, and on the degree of change in the modification magnitudes in the middle zone 42of the thread depth h.

Figure 7:
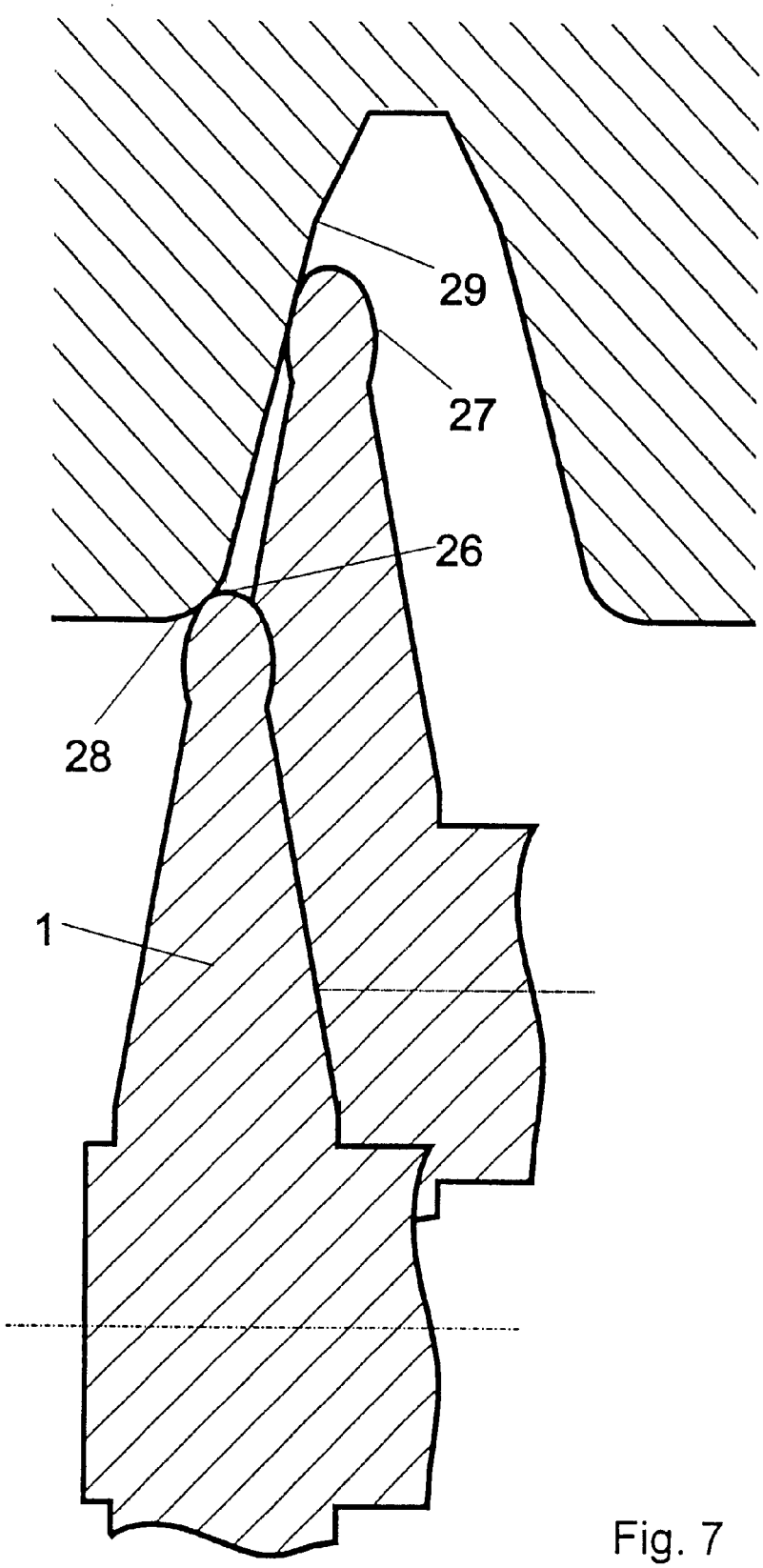
FIG. 7 shows a special profiling tool with two tool radiuses per flank.

A further possibility for reducing the substantial profiling times when producing worm thread flank modifications by line-by-line profiling and continual lead change of the worm thread is given by the use of the profiling tool 1 shown in FIG. 7. The tool has in its active zone a tip radius 26 and a flank radius 27 on both side flanks adjoining the tip radius. A special feature of this profiling tool is that the flank radius 27 is much larger than the tip radius 26, preferably by a factor of at least 10. The use of this profiling tool is particularly appropriate in cases where, for producing the required desired worm flank modifications, line-by-line profiling with a relatively large radius 27 of the profiling tool 1 is permissible, but where at the same time thread zones with tight curvature such as tip radii 28 and flank profile reliefs 29 have to be profiled. The small tip radius 26 of the profiling tool depicted in FIG. 7 is used to perform profiling in worm thread zones of tight curvature. To ensure favorable positioning of the profiling tool, it may be necessary to pivot the profiling tool or the grinding worm by means of the axes of rotation (F or C) mentioned earlier. In contrast, the flank zones of the worm thread with relatively slight curvature (due to the modifications) are profiled using the flank radius 27 of the profiling tool. The advantage of using the large flank radius is that it allows for selection of a larger infeed from one profiling line to the next, thus reducing profiling time without adversely affecting the form error of the profile contour during generation grinding of the gear.

Applicable to all of the profiling processes described above, is that the modifications of the grinding worm thread flanks to be generated may extend across the entire width of the grinding worm (b,) or only across a defined width zone. For an optimum exploitation of the whole grinding worm width, however, the following procedure is advantageous.

The extent of the zone of the grinding worm requiring modifications is mainly influenced by the length of the paths of contact 9 and 10 between the gear and the grinding worm, as well as by the stroke 11 during diagonal generation grinding (FIGS. 2*a* and 2*b*). The length of stroke in turn influences strongly the amount of change in modification values in the axial direction of the grinding worm. The modifications in the axial direction of the worm are stretched with a greater stroke length and are compressed with a shorter stroke. In this manner, it is possible to distribute the modification values along the worm thread flank, and thus exert a controlled influence on the residual errors during profile dressing with a pivoting profile tool or a pivoting grinding worm. Furthermore, enlarging the modified worm zone results in an increase in the number of workpieces that can be ground by the diagonal generation process with this section until worm thread wear sets in without sacrificing quality.

Conversely, it should be noted that the unmodified zone of the grinding worm becomes smaller as the modified zone of the grinding worm increases in size. The former is needed, however, as the modified grinding worm would be worn rapidly when applying high volumetric abrasion rates. Consequently, it is appropriate to divide the grinding worm into two zones as described below.

Figure 8:
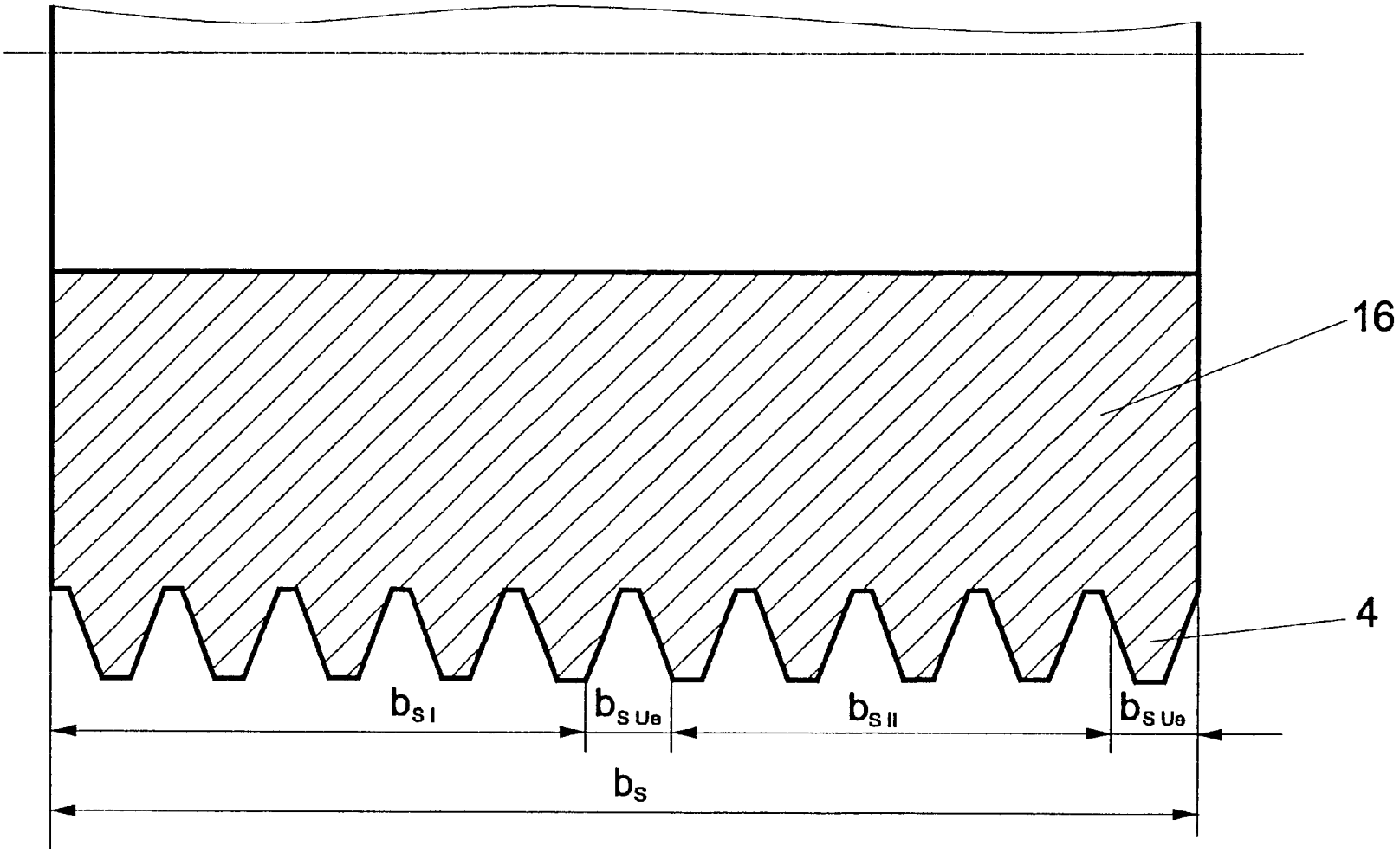
FIG. 8 shows a division of the grinding worm into differently profiled zones.

Zone I remains unmodified and is utilized for the stroke strategies conventionally used in continuous generation rough-grinding. The zone II on the other hand receives the thread flank modifications needed to generate the tooth flank modifications for finish-grinding. Between the modified and unmodified zones of the grinding worm are transition zones $b_{sue}$, in which the individual machine axes needed to produce the modifications move either from the zero position to the first required position of the modified zone or from the last position of the modified zone to the zero position. In observance of the quality criteria, the width of both sections should be selected such that they become worn or consumed within about the same life duration. This results in the optimal division of the width of the grinding worm into modified and unmodified zones. FIG. 8 depicts typically a grinding worm 16 which is divided across its width into an unmodified zone ($b_{sI}$), a modified zone ($b_{sII}$), and the transitional zone ($b_{sue}$) between them.

Another important feature in this connection is the fact that, because of the tightly limited surface area of contact between the profiling tool and the worm thread in line-by-line profiling, the zones may be overlapped from level to level with respect to the worm thread depth. A separate transition between the unmodified and modified zones can be determined for each profiling line in relationship with the position of the lines of action 9 and 10 (FIG. 2*a*). This allows for an even more favorable exploitation of the grinding tool.

What is claimed is:

1. A method of profiling flanks of a thread of a cylindrical grinding worm for the diagonal generating grinding of gears, by a disc shaped profiling tool, the grinding worm having a width and the thread having al depth, the grinding worm rotating around a first axis and the profiling tool rotating around a second axis and being coated on a torus shaped peripheral first working surface with grains of hard material, the method comprising the steps of:

a) moving the profiling tool relative to the grinding worm in a plurality of successive strokes parallel to the first axis;

b) synchronising an axial position of the profiling tool relative to the grinding worm with a rotation angle of the grinding worm during each of these strokes;

c) performing infeed steps of the profiling tool relative to the grinding worm perpendicular to the first axis between successive strokes, each infeed step being only a fraction of the depth of the thread; and d) superimposing in steps a) and b) an additional correcting movement in the direction of the first axis over at least a first section of the width of the grinding worm, said additional correcting movement changing continuously over said first section and changing continuously between successive infeed steps towards a middle of the depth of the thread.

2. The method according to claim 1, wherein the profiling tool has a second working surface coated with grains of hard material and adjoining the first working surface, the second working surface being adapted for profile dressing of the flanks of the grinding worm thread, wherein the method steps a) through d) are performed only over the first section of the width of the grinding worm, wherein in a second section of the width the flanks are profiled with the second working surface.

3. The method according to claim 1, wherein the profiling tool has a second working surface coated with grains of hard material and adjoining the first working surface, wherein the steps a) through d) are performed only in an outermost first section of the depth of the thread and in an innermost second section of the depth of the thread, the method further comprising the steps of:

$e_1$) moving the second working surface into contact with one of the flanks in an intermediate third section of the depth of the thread;

$f_1$) moving the profiling tool relative to the grinding worm parallel to the first axis;

$g_1$) synchronising the axial position of the profiling tool relative to the grinding worm with the rotation angle of the grinding worm; and $h_1$) pivoting the profiling tool relative to the grinding worm around a third axis which is perpendicular to one of said first and second axes, a pivot angle between the profiling tool and the grinding worm changing continuously during step f) over said first section of the width of the grinding worm.

4. The method according to claim 3, wherein the method steps a) through h) are performed only over the first section of the width of the grinding worm, wherein in a second section of the width the flanks are profiled with the second surface without pivoting motion of the profiling tool relative to the grinding worm.

5. The method according to claim 1, wherein the profiling tool has a second torus shaped working surface coated with grains of hard material and adjoining the first working surface, a radius of curvature of the second working surface as seen in an axial section being at least ten times larger than a radius of curvature of the first working surface, wherein the steps a) through d) are performed with the first working surface in an outermost first section of the depth of the thread and in an innermost second section of the depth of the thread, the infeed steps being first infeed steps, the method further comprising the steps of:

$e_2$) bringing the second working surface into contact with one of the flanks at one end of an intermediate third section of the depth of the thread;

$f_2$) repeating steps a) and b);

$g_2$) performing second infeed steps which are larger than the first infeed steps of the profiling tool relative to the grinding worm perpendicular to the first axis between successive strokes;

$h_2$) repeating step d).

6. An apparatus for profiling flanks of a thread of a cylindrical grinding worm for diagonal generating grinding of gears, the grinding worm having a width, the apparatus comprising:

a grinding spindle for mounting the grinding worm, the grinding spindle being rotatable around a first axis and being connected to a first motor and to a first encoder for measuring a rotation angle of the grinding spindle;

a tool spindle for mounting a disc-shaped profiling tool having a conical working surface coated with grains of hard material, the tool spindle being rotatable around a second axis and being connected to a second motor;

a first slide for displacing the tool spindle relative to the grinding spindle in a first direction by means of a third motor, the displacement of the first slide being measured by a second encoder;

a second slide for displacing the tool spindle relative to the grinding spindle in a second direction perpendicular to the first direction by means of a fourth motor, the displacement of the second slide being measured by a third encoder;

a turn table for pivoting the tool spindle relative to the grinding spindle around a third axis which is perpendicular to the first direction and to the second direction, the turn table being connected to a fifth motor and to a fourth encoder for measuring a pivot angle of the turn table;

a programmable NC control unit connected to all motors and to all encoders;

wherein the control unit is programmed such that in operation the profiling tool is moved with its working surface into contact with a flank of the thread of the grinding worm at one axial end thereof by means of at least one of the first slide and the second slide, the profiling tool is moved along the grinding worm by means of at least one of the second slide and the first slide parallel to the first axis synchronously with a turning angle of the, grinding spindle and, simultaneously with the movement parallel to the first axis the turn table is pivoted continuously around the third axis by means of the, fifth motor over at least one sector of the width of the grinding worm, the pivot angle of the turn table changing continuously within said sector.

* * * * *